United States Patent [19]

Girard

[11] Patent Number: 4,510,707

[45] Date of Patent: Apr. 16, 1985

[54] ORNAMENTAL ASSEMBLY

[76] Inventor: Leroy Girard, 2701 Holland St., Erie, Pa. 16504

[21] Appl. No.: 408,185

[22] Filed: Aug. 16, 1982

[51] Int. Cl.[3] ..... G09F 1/12

[52] U.S. Cl. ..... 40/152; 40/27.5; 40/152.1; 40/154; 40/605; 428/7; 428/10

[58] Field of Search ..... 40/152, 152.1, 154, 40/155, 157, 158, 27.5, 605, 323; 46/23, 26, 30, 31; 428/7, 8, 9, 10, 11, 12

[56] References Cited

U.S. PATENT DOCUMENTS

| | | | |
|---|---|---|---|
| 1,648,706 | 11/1927 | Walker | 46/31 |
| 2,132,647 | 10/1938 | Robins | 46/26 |
| 2,201,201 | 5/1940 | Protz | 428/11 |
| 3,471,959 | 10/1967 | Seger | 40/152 |
| 3,518,787 | 7/1970 | Anello, Sr. et al. | 46/26 |
| 3,614,835 | 10/1971 | Rice et al. | 46/31 |
| 3,673,723 | 7/1972 | Lazar et al. | 40/152.1 |
| 3,898,870 | 8/1975 | Jacobson | 40/156 |
| 3,982,343 | 9/1976 | Klinger | 40/27.5 |
| 4,043,477 | 8/1977 | Deese | 40/27.5 |
| 4,115,938 | 9/1978 | Belmuth et al. | 40/152 |
| 4,165,573 | 8/1979 | Richards | 40/152 |
| 4,170,082 | 10/1979 | Freedman | 46/30 |
| 4,286,400 | 9/1981 | MacPherson et al. | 40/152 |

FOREIGN PATENT DOCUMENTS

| | | | |
|---|---|---|---|
| 1164295 | 2/1964 | Fed. Rep. of Germany | 46/30 |
| 1511150 | 9/1978 | Fed. Rep. of Germany | 40/323 |
| 3029867 | 1/1981 | Fed. Rep. of Germany | 40/154 |
| 2231297 | 12/1974 | France | 40/152 |

*Primary Examiner*—Gene Mancene
*Assistant Examiner*—James Hakomaki
*Attorney, Agent, or Firm*—Charles L. Lovercheck; Wayne L. Lovercheck; Dale R. Lovercheck

[57] ABSTRACT

Connectable picture frame units are disclosed. The picture frame units are in the form of a rectangular sheet of rigid material with a raised rim on the front encircling a space for a picture. A snap attachment ring snaps onto the raised rim and holds the picture in the frame unit. Raised pins are disposed on the back of the picture frame units and are received in assembly links in order to connect the picture frame units. The units can be connected in rectangular and diagonal fashion to form borders, frames, Christmas wreaths, multiple displays, and decorative swags for Christmas and other occasions.

7 Claims, 16 Drawing Figures

ORNAMENTAL ASSEMBLY

OBJECTS OF THE INVENTION

It is an object of the invention to provide an improved Christmas tree and Christmas tree ornament combination.

Another object of the invention is to provide an improved Christmas tree ornament.

Another object of the invention is to provide a Christmas tree ornament wherein a picture is supported behind a hole in a card and the card is rectangular in shape and has a support at its upper corner for supporting it on a Christmas tree or the like.

Another object of the invention is to provide a Christmas tree ornament that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figures 1, 2, 3, 4, 5, 6, 7, 8, 9, 10, 11, 12, 13, 14, 15, 16:
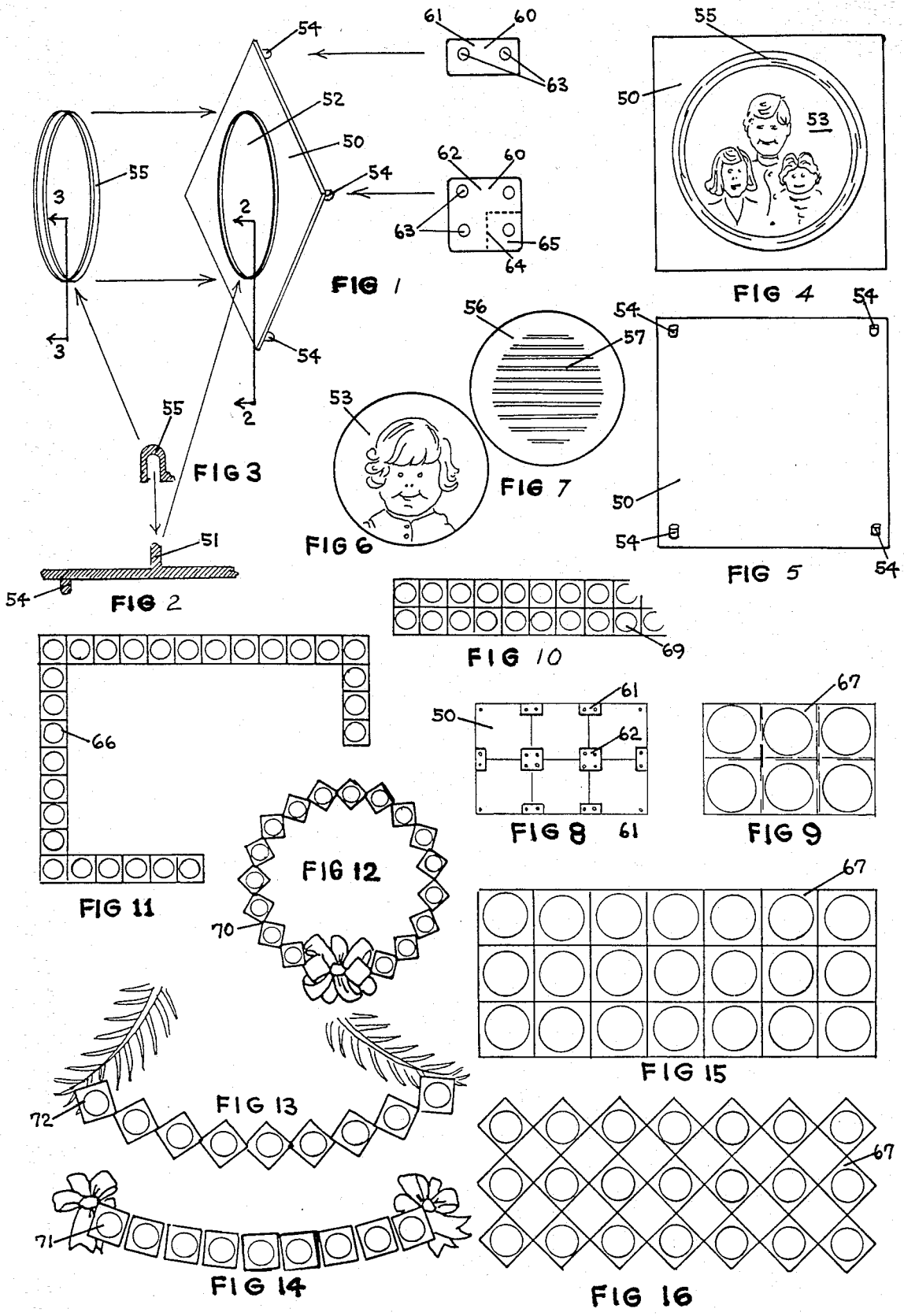
FIG. 1 is an exploded view of the picture frame unit and assembly links.
FIG. 2 is a cross sectional view of the body of the picture frame unit along Line 2—2 on FIG. 1.
FIG. 3 is a cross sectional view of the snap attachment ring along Line 3—3 on FIG. 1.
FIG. 4 is a front view of an assembled picture frame unit.
FIG. 5 is a back view of the picture frame unit.
FIG. 6 is a front view of a picture.
FIG. 7 is the back view of a sample picture showing printed instructions.
FIG. 8 is the back view of a multiple display of connected picture frame units showing the assembly links.
FIG. 9 is a front view of a multiple display of connected picture frame units.
FIG. 10 is a front view of a border of connected picture frame units.
FIG. 11 is a front view of a frame of connected picture frame units.
FIG. 12 is a front view of a Christmas wreath made of picture frame units connected in a circle.
FIG. 13 is a drawing of the picture frame units connected in diagonal fashion to form a swag ornamentation for a Christmas tree.
FIG. 14 is a drawing of the picture frame units connected in rectangular fashion to form a swag ornamentation.
FIG. 15 is a front view of a multiple display of picture frame units connected in rectangular fashion.
FIG. 16 is a front view of a multiple display of picture frame units connected in diagonal fashion.

Now with more particular reference to the drawings, the picture frame units, as shown in FIG. 1 are made of a square sheet of rigid material 50 with a raised rim 51 on the front of the sheet, encirclilng a space 52 where a picture 53 is placed. The snap attachment ring 55 snaps into position on the raised rim 51, as shown in FIGS. 2 and 3. The snap attachment ring 55 holds the picture in the frame by pinching the edge of the picture between the ring and the sheet 50. Raised pins 54 are fixed to sheet 50 and disposed at each corner of the back of the square sheet 50, as shown in FIG. 5. The pins are received in assembly links 60 to connect the picture frame units together. The pins also function as means to attach the ornaments to a Christmas tree. Assembly link 61 is rectangular and has two holes 63 to connect the corners of two picture frame units. The assembly link 62 is square and has four holes 63 to connect four picture frame units together. Imbedded markings 64 on assembly link 62 make it easy to detach section 65, modifying assembly link 62 to have only three holes 63. The modified assembly link 62 is capable of connecting three picture frame units to form the corner of a frame of units, as shown in FIG. 11.

A sample picture 53 is shown in FIG. 7. The back of the picture 56 has printed instructions 57 on it and can be used as a tracing guide to cut out other pictures for the frame.

The picture frame units can be connected to form borders, as shown in FIG. 10, frames as shown in FIG. 11, multiple displays as shown in FIGS. 8, 9, 15 and 16, decorative swags for Christmas and other occasions as shown in FIGS. 13 and 14 and circles or wreaths as shown in FIG. 12. The multiple displays of pictures can be made of picture frame units connected in a rectangular fashion as shown in FIG. 15, or in a diagonal fashion as shown in FIG. 16. The decorative swags can also be made of picture frame units connected in a rectangular fashion as shown in FIG. 14, or in a diagonal fashion, as shown in FIG. 13.

The foregoing specification sets forth the invention in its preferred, practical forms but the structure shown is capable of modification within a range of equivalents without departing from the invention which is understood is broadly novel as is commensurate with the appended claims.

The embodiments of the invention in which an exclusive property or privilege is claimed are defined as follows:

1. In combination, an ornamentation for a Christmas tree and means to support said ornamentation on a Christmas tree comprising, a plurality of square shaped picture frame units, each said frame unit comprising: a generally circular raised rim disposed adjacent to the central part of a sheet on a first side thereof and defining a circular space and extending substantially entirely around said circular space, a ring, U-shaped in cross section at each side of said ring, said U-shaped cross section frictionally receiving said rim and releasably holding said rim in place, a picture disposed within said rim, said U-shaped ring being snapped on said rim, said ring overlying an edge of said picture, holding said picture in position, means to connect said picture frame units together, said means to connect said picture frame units comprising raised pins on the back of said picture frame units, and assembly links having spaced holes for receiving said raised pins holding said frame units together providing an assembly of pictures in said frames for display on said tree, whereby a plurality of pictures can be supported on said tree as ornaments thereon, one said assembly link being adapted to link together one said corner form each of two said units, said assembly link being rectangular with at least two holes, each adapted to receive one said raised pin, one said assembly link is adapted to link together one said corner of each of four said units.

2. The ornamentation recited in claim 1 wherein said assembly link 62 is square with four holes 63, each adapted to receive one said raised pin 54.

3. The ornamentation recited in claim 1 wherein said units in each said display are connected along diagonal lines 68.

4. The ornamentation recited in claim 1 wherein the plurality of said picture frame units forms a border defining an open space.

5. The ornamentation recited in claim 1 wherein the plurality of said picture frame units forms a circular display.

6. The ornamentation recited in claim 1 wherein the plurality of said picture frame units forms a swag 71.

7. The ornamentation recited in claim 6 wherein said frames in said swag are connected in a rectangular fashion.

* * * * *